US005948591A

United States Patent [19]

Vermeersch et al.

[11] Patent Number: 5,948,591

[45] Date of Patent: Sep. 7, 1999

[54] HEAT SENSITIVE IMAGING ELEMENT AND A METHOD FOR PRODUCING LITHOGRAPHIC PLATES THEREWITH

[75] Inventors: Joan Vermeersch, Deinze; Marc Van Damme, Heverlee, both of Belgium

[73] Assignee: Agfa-Gevaert, N.V., Mortsel, Belgium

[21] Appl. No.: 09/073,428

[22] Filed: May 6, 1998

Related U.S. Application Data

[60] Provisional application No. 60/050,856, Jun. 26, 1997.

[30] Foreign Application Priority Data

May 27, 1997 [EP] European Pat. Off. ..... 97201560

[51] Int. Cl.[6] ..... G03C 1/72; G03C 5/16

[52] U.S. Cl. ..... 430/270.1; 430/909; 430/322; 430/944; 430/330

[58] Field of Search ..... 430/270.1, 944, 430/909, 322, 330

[56] References Cited

U.S. PATENT DOCUMENTS

| | | | |
|---|---|---|---|
| 3,847,614 | 11/1974 | Mattor | 96/75 |
| 4,004,924 | 1/1977 | Vrancken et al. | 96/35 |
| 4,115,613 | 9/1978 | Inoue et al. | 428/207 |
| 4,828,959 | 5/1989 | Pawlowksi et al. | 430/175 |
| 5,126,504 | 6/1992 | Mueller-Hess et al. | 430/96 |

FOREIGN PATENT DOCUMENTS

| | | |
|---|---|---|
| 0 514 145 | 11/1992 | European Pat. Off. . |
| 57-59799 | 4/1982 | Japan . |

*Primary Examiner*—Janet Baxter
*Assistant Examiner*—Jill N. Holloman
*Attorney, Agent, or Firm*—Breiner & Breiner

[57] ABSTRACT

According to the present invention there is provided a heat sensitive imaging element comprising a lithographic base with a hydrophilic surface, an image forming layer including a hydrophobic thermoplastic polymer latex and a compound capable of converting light into heat being present in said image forming layer or a layer adjacent thereto, characterized in that the image forming layer includes an alkali soluble copolymer containing acetal groups and hydroxy groups which have at least partially reacted with a compound with at least two carboxyl groups.

9 Claims, No Drawings

HEAT SENSITIVE IMAGING ELEMENT AND A METHOD FOR PRODUCING LITHOGRAPHIC PLATES THEREWITH

This Application claims benefit of provisional application number 60/050,856 filed Jun. 26, 1997.

DESCRIPTION

1. Field of the Invention

The present invention relates to a heat sensitive material for making a lithographic printing plate. The present invention further relates to a method for preparing a printing plate from said heat sensitive material.

2. Background of the Invention

Lithography is the process of printing from specially prepared surfaces, some areas of which are capable of accepting lithographic ink, whereas other areas, when moistened with water, will not accept the ink. The areas which accept ink form the printing image areas and the ink-rejecting areas form the background areas.

In the art of photolithography, a photographic material is made imagewise receptive to oily or greasy ink in the photo-exposed (negative working) or in the non-exposed areas (positive working) on a hydrophilic background.

In the production of common lithographic plates, also called surface litho plates or planographic printing plates, a support that has affinity to water or obtains such affinity by chemical treatment is coated with a thin layer of a photosensitive composition. Coatings for that purpose include light-sensitive polymer layers containing diazo compounds, dichromate-sensitized hydrophilic colloids and a large variety of synthetic photopolymers. Particularly diazo-sensitized systems are widely used.

Upon imagewise exposure of the light-sensitive layer the exposed image areas become insoluble and the unexposed areas remain soluble. The plate is then developed with a suitable liquid to remove the diazonium salt or diazo resin in the unexposed areas.

On the other hand, methods are known for making printing plates involving the use of imaging elements that are heat sensitive rather than photosensitive. A particular disadvantage of photosensitive imaging elements such as described above for making a printing plate is that they have to be shielded from the light. Furthermore they have a problem of sensitivity in view of the storage stability and they show a lower resolution. The trend towards heat sensitive printing plate precursors is clearly seen on the market.

For example, Research Disclosure no. 33303 of January 1992 discloses a heat sensitive imaging element comprising on a support a cross-linked hydrophilic layer containing thermoplastic polymer particles and an infrared absorbing pigment such as e.g. carbon black. By image-wise exposure to an infrared laser, the thermoplastic polymer particles are image-wise coagulated thereby rendering the surface of the imaging element at these areas ink acceptant without any further development. A disadvantage of this method is that the printing plate obtained is easily damaged since the non-printing areas may become ink accepting when some pressure is applied thereto. Moreover, under critical conditions, the lithographic performance of such a printing plate may be poor and accordingly such printing plate has little lithographic printing latitude.

EP-A-514145 discloses a heat sensitive imaging element including a coating comprising core-shell particles having a water insoluble heat softenable core component and a shell component which is soluble or swellable in aqueous alkaline medium. Red or infrared laser light directed image-wise at said imaging element causes selected particles to coalesce, at least partially, to form an image and the non-coalesced particles are then selectively removed by means of an aqueous alkaline developer. Afterwards a baking step is performed. However the printing endurance of a so obtained printing plate is low.

EP-A-599510 discloses a heat sensitive imaging element which comprises a substrate coated with (i) a layer which comprises (1) a disperse phase comprising a water-insoluble heat softenable component A and (2) a binder or continuous phase consisting of a component B which is soluble or swellable in aqueous, preferably aqueous alkaline medium, at least one of components A and B including a reactive group or precursor therefor, such that insolubilization of the layer occurs at elevated temperature and/or on exposure to actinic radiation, and (ii) a substance capable of strongly absorbing radiation and transferring the energy thus obtained as heat to the disperse phase so that at least partial coalescence of the coating occurs. After image-wise irradiation of the imaging element and developing the image-wise irradiated plate, said plate is heated and/or subjected to actinic irradiation to effect insolubilization. However the printing endurance of a so obtained printing plate is low.

EP-A-625728 discloses an imaging element comprising a layer which is sensitive to UV- and IR-irradiation and which can be positive or negative working. This layer comprises a resole resin, a novolac resin, a latent Bronsted acid and an IR-absorbing substance. The printing results of a lithographic plate obtained by irradiating and developing said imaging element are poor.

U.S. Pat. No. 5,340,699 is almost identical with EP-A-625728 but discloses the method for obtaining a negative working IR-laser recording imaging element. The IR-sensitive layer comprises a resole resin, a novolac resin, a latent Bronsted acid and an IR-absorbing substance. The printing results of a lithographic plate obtained by irradiating and developing said imaging element are poor.

U.S. Pat. No. 4,708,925 discloses a positive working imaging element including a photosensitive composition comprising an alkali-soluble novolac resin and an onium-salt. This composition can optionally contain an IR-sensitizer. After image-wise exposing said imaging element to UV—visible—or eventually IR-radiation followed by a development step with an aqueous alkali liquid there is obtained a positive working printing plate. The printing results of a lithographic plate obtained by irradiating and developing said imaging element are poor.

EP-A-514145 discloses a method for forming images by direct radiation, such as red or infra-red laser light, at a radiation sensitive plate and modulating the radiation. The radiation-sensitive plate includes a coating comprising coreshell particles having a water insoluble heat softenable core compound and a shell compound which is soluble or swellable in aqueous alkaline medium. Said shell shell compound cab be a dicarboxylic acid half ester of hydroxylgroup-containing polylers. Said material does not contain a hydrophobic thermoplastic polymer latex.

EP-A-96200972.6 discloses a heat sensitive imaging element comprising on a hydrophilic surface of a lithographic base an image forming layer comprising hydrophobic thermoplastic polymer particles dispersed in a water insoluble alkali soluble or swellable resin and a compound capable of converting light into heat, said compound being present in said image forming layer or a layer adjacent thereto, wherein said alkali swellable or soluble resin comprises phenolic hydroxy groups and/or carboxyl groups. However by exposure with short pixel times of said heat-sensitive imaging element there occurs ablation on the exposed areas resulting in an insufficient ink acceptance.

All the disclosed systems either require a treatment after the development step and/or or yield lithographic plates with poor printing properties. So, there is still a need for a heat sensitive imaging element that is easy to process and yields a lithographic plate with good or excellent printing properties.

3. SUMMARY OF THE INVENTION

It is an object of the present invention to provide a heat sensitive imaging element for making in a convenient way a lithographic printing plate having excellent ink acceptance.

It is another object of the present invention to provide a method for obtaining in a convenient way a negative working lithographic printing plate with an excellent ink acceptance using said imaging element.

It is still another object of the present invention to provide a method for obtaining in a convenient way a negative working lithographic printing plate which gives prints with excellent printing properties using said imaging element.

Further objects of the present invention will become clear from the description hereinafter.

According to the present invention there is provided a heat sensitive imaging element comprising a lithographic base with a hydrophilic surface, an image forming layer including a hydrophobic thermoplastic polymer latex and a compound capable of converting light into heat being present in said image forming layer or a layer adjacent thereto, characterized in that the image forming layer includes a copolymer containing acetal groups and hydroxy groups which have at least partially reacted with a compound with at least two carboxyl groups.

According to the present invention there is also provided a method for obtaining a lithographic printing plate comprising the steps of:

(a) image-wise or information-wise exposing to light or heat an imaging element as described above (b) developing said exposed imaging element with an aqueous developing solution in order to remove the unexposed areas and thereby form a lithographic printing plate.

4. DETAILED DESCRIPTION OF THE INVENTION

It has been found that lithographic printing plates of high quality, giving prints with excellent ink acceptance can be obtained according to the method of the present invention using an imaging element as described above. More precisely it has been found that said printing plates are of high quality and are provided in a convenient way, thereby offering economical and ecological advantages.

The copolymer containing acetal groups and hydroxy groups which have at least partially reacted with a compound with at least two carboxyl groups are preferably soluble in an aqueous solution with a pH of at least 6.

Preferably the molecular weight of the copolymer used in connection with the present invention ranges from 10,000 to 1,000,000, more preferably from 20,000 to 300,000.

The copolymer used in connection with the present embodiment is preferably not cross-linked or only slightly cross-linked.

Very preferred copolymers for use according to the present invention have a structure as represented by formula I, wherein n ranges from 50 to 78%
m ranges from 21 to 49%
p ranges from 1 to 5%
q ranges from 0 to 28%

Form I

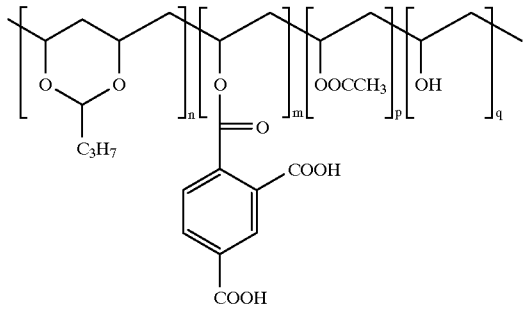

According to one embodiment of the present invention, the lithographic base having a hydrophilic surface can be an anodised aluminum. A particularly preferred lithographic base having a hydrophilic surface is an electrochemically grained and anodised aluminum support. Most preferably said aluminum support is grained in nitric acid, yielding imaging elements with a higher sensitivity. According to the present invention, an anodised aluminum support may be treated to improve the hydrophilic properties of its surface. For example, the aluminum support may be silicated by treating its surface with sodium silicate solution at elevated temperature, e.g. 95° C. Alternatively, a phosphate treatment may be applied which involves treating the aluminum oxide surface with a phosphate solution that may further contain an inorganic fluoride. Further, the aluminum oxide surface may be rinsed with a citric acid or citrate solution. This treatment may be carried out at room temperature or can be carried out at a slightly elevated temperature of about 30 to 50° C. A further interesting treatment involves rinsing the aluminum oxide surface with a bicarbonate solution. Still further, the aluminum oxide surface may be treated with polyvinylphosphonic acid, polyvinylmethylphosphonic acid, phosphoric acid esters of polyvinyl alcohol, polyvinylsulphonic acid, polyvinylbenzenesulphonic acid, sulphuric acid esters of polyvinyl alcohol, and acetals of polyvinyl alcohols formed by reaction with a sulphonated aliphatic aldehyde. It is further evident that one or more of these post treatments may be carried out alone or in combination.

According to another embodiment in connection with the present invention, the lithographic base having a hydrophilic surface comprises a flexible support, such as e.g. paper or plastic film, provided with a cross-linked hydrophilic layer. A particularly suitable cross-linked hydrophilic layer may be obtained from a hydrophilic binder cross-linked with a cross-linking agent such as formaldehyde, glyoxal, polyisocyanate or a hydrolysed tetra-alkylorthosilicate. The latter is particularly preferred.

As hydrophilic binder there may be used hydrophilic (co)polymers such as for example, homopolymers and copolymers of vinyl alcohol, acrylamide, methylol acrylamide, methylol methacrylamide, acrylic acid, methacrylic acid, hydroxyethyl acrylate, hydroxyethyl methacrylate or maleic anhydride/vinylmethylether copolymers. The hydrophilicity of the (co)polymer or (co)polymer mixture used is preferably the same as or higher than the hydrophilicity of polyvinyl acetate hydrolyzed to at least an extent of 60 percent by weight, preferably 80 percent by weight.

The amount of crosslinking agent, in particular of tetraalkyl orthosilicate, is preferably at least 0.2 parts by weight per part by weight of hydrophilic binder, preferably between 0.5 and 5 parts by weight, more preferably between 1.0 parts by weight and 3 parts by weight.

A cross-linked hydrophilic layer in a lithographic base used in accordance with the present embodiment preferably also contains substances that increase the mechanical strength and the porosity of the layer. For this purpose colloidal silica may be used. The colloidal silica employed may be in the form of any commercially available water-dispersion of colloidal silica for example having an average particle size up to 40 nm, e.g. 20 nm. In addition inert particles of larger size than the colloidal silica can be added e.g. silica prepared according to Stöber as described in J. Colloid and Interface Sci., Vol. 26, 1968, pages 62 to 69 or alumina particles or particles having an average diameter of at least 100 nm which are particles of titanium dioxide or other heavy metal oxides. By incorporating these particles the surface of the cross-linked hydrophilic layer is given a uniform rough texture consisting of microscopic hills and valleys, which serve as storage places for water in background areas.

The thickness of a cross-linked hydrophilic layer in a lithographic base in accordance with this embodiment may vary in the range of 0.2 to 25 $\mu$m and is preferably 1 to 10 $\mu$m.

Particular examples of suitable cross-linked hydrophilic layers for use in accordance with the present invention are disclosed in EP-A 601240, GB-P-1419512, FR-P-2300354, U.S. Pat. No. 3,971,660, U.S. Pat. No. 4,284,705 and EP-A 514490.

As flexible support of a lithographic base in connection with the present embodiment it is particularly preferred to use a plastic film e.g. substrated polyethylene terephthalate film, cellulose acetate film, polystyrene film, polycarbonate film etc. The plastic film support may be opaque or transparent.

It is particularly preferred to use a polyester film support to which an adhesion improving layer has been provided. Particularly suitable adhesion improving layers for use in accordance with the present invention comprise a hydrophilic binder and colloidal silica as disclosed in EP-A 619524, EP-A 620502 and EP-A 619525. Preferably, the amount of silica in the adhesion improving layer is between 200 mg per $m^2$ and 750 mg per $m^2$. Further, the ratio of silica to hydrophilic binder is preferably more than 1 and the surface area of the colloidal silica is preferably at least 300 $m^2$ per gram, more preferably at least 500 $m^2$ per gram.

The hydrophobic thermoplastic polymer latices used in connection with the present invention preferably have a coagulation temperature above 50° C. and more preferably above 70° C. Coagulation may result from softening or melting of the thermoplastic polymer latices under the influence of heat. There is no specific upper limit to the coagulation temperature of the thermoplastic hydrophobic polymer latices, however the temperature should be sufficiently below the decomposition temperature of the polymer latices. Preferably the coagulation temperature is at least 10° C. below the temperature at which the decomposition of the polymer latices occurs. When said polymer latices are subjected to a temperature above the coagulation temperature they coagulate to form a hydrophobic agglomerate so that at these parts the hydrophobic latices become insoluble in plain water or an aqueous liquid.

Specific examples of hydrophobic thermoplastic polymer latices for use in connection with the present invention with a Tg above 80° C. are preferably polyvinyl chloride, polyvinylidene chloride, polyacrylonitrile, polyvinyl carbazole etc., copolymers or mixtures thereof. More preferably used are polymethyl-methacrylate or copolymers thereof. Most preferably used are polystyrene copolymers and particularly polystyrene itself or polymers of substituted styrene.

The weight average molecular weight of the hydrophobic thermoplastic polymer may range from 5,000 to 1,000,000 g/mol.

The hydrophobic thermoplastic polymer latex may have a particle size from 0.01 $\mu$m to 50 $\mu$m, more preferably between 0.01 $\mu$m and 10 $\mu$m, still more preferably between 0.01 $\mu$m and 1 $\mu$m and most preferably between 0.02 $\mu$m and 0.10 $\mu$m.

The hydrophobic thermoplastic polymer latex is present as a dispersion in the aqueous coating liquid of the image forming layer and may be prepared by the methods disclosed in U.S. Pat. No. 3,476,937. Another method especially suitable for preparing an aqueous dispersion of the thermoplastic polymer latex comprises:

dissolving the hydrophobic thermoplastic polymer in an organic water immiscible solvent, dispersing the thus obtained solution in water or in an aqueous medium and removing the organic solvent by evaporation.

The amount of hydrophobic thermoplastic polymer latex contained in the image forming layer is preferably between 20% by weight and 95% by weight and more preferably between 40% by weight and 90% by weight and most preferably between 50% by weight and 85% by weight.

The image forming layer can also comprise crosslinking agents although this is not necessary. Preferred crosslinking agents are low molecular weight substances comprising a methylol group such as for example melamine-formaldehyde resins, glycoluril-formaldehyde resins, thiourea-formaldehyde resins, guanamine-formaldehyde resins, benzoguanamine-formaldehyde resins. A number of said melamine-formaldehyde resins and glycoluril-formaldehyde resins are commercially available under the trade names of CYMEL (Dyno Cyanamid Co., Ltd.) and NIKALAC (Sanwa Chemical Co., Ltd.)

The imaging element further includes a compound capable of converting light to heat. Suitable compounds capable of converting light into heat are preferably infrared absorbing components although the wavelength of absorption is not of particular importance as long as the absorption of the compound used is in the wavelength range of the light source used for image-wise exposure. Particularly useful compounds are for example dyes and in particular infrared dyes, carbon black, metal carbides, borides, nitrides, carbonitrides, bronze-structured oxides and oxides structurally related to the bronze family but lacking the A component e.g. $WO_{2.9}$. It is also possible to use conductive polymer dispersion such as polypyrrole or polyaniline-based conductive polymer dispersions. The lithographic performance and in particular the print endurance obtained depends on the heat-sensitivity of the imaging element. In this respect it has been found that carbon black yields very good and favorable results.

A light to heat converting compound in connection with the present invention is most preferably added to the image forming layer but at least part of the light to heat converting compound may also be comprised in a neighbouring layer. Such layer can be for example the cross-linked hydrophilic layer of the lithographic base according to the second embodiment of lithographic bases explained above.

In accordance with a method of the present invention for obtaining a printing plate, the imaging element is image-wise exposed to heat or light and subsequently developed with an aqueous solution having a pH of at least 6.

Image-wise exposure in connection with the present invention is preferably an image-wise scanning exposure involving the use of a laser or L.E.D. It is highly preferred in connection with the present invention to use a laser emitting in the infrared (IR) and/or near-infrared, i.e. emitting in the wavelength range 700–1500 nm. Particularly preferred for use in connection with the present invention are laser diodes emitting in the near-infrared.

After the development of an image-wise exposed imaging element with an aqueous alkaline solution and drying the obtained plate can be used as a printing plate as such. However it is preferred to treat said plate with a gumming solution. A gumming solution contains a water soluble (co)polymer for example a synthetic homo- or copolymer such as polyvinylalcohol, a poly(meth)acrylic acid, a poly (meth)acrylamide, a polyhydroxyethyl(meth)acrylate, a polyvinylmethylether or a natural binder such as gelatin, a polysaccharide such as e.g. dextran, pullulan, cellulose, arabic gum, alginic acid. e.g. However, it is also possible to bake a gummed or ungummed developed plate at a temperature between 100° C. and 300° C. for a period of 40 minutes to 30 seconds. For example the exposed and developed plates can be baked at a temperature of 270° C. for 2 minutes, at a temperature of 230° C. for 5 minutes, at a temperature of 150° C. for 10 minutes or at a temperature of 120° C. for 30 minutes.

The following examples illustrate the present invention without limiting it thereto. All parts are by weight unless otherwise specified.

EXAMPLE 1

(Comparative Example)

Preparation of the lithographic base

A 0.20 mm thick aluminum foil was degreased by immersing the foil in an aqueous solution containing 5 g/l of sodium hydroxide at 50° C. and rinsed with demineralized water. The foil was then electrochemically grained using an alternating current in an aqueous solution containing 4 g/l of hydrochloric acid, 4 g/l of hydroboric acid and 5 g/l of aluminum ions at a temperature of 35° C. and a current density of 1200 A/m$^2$ to form a surface topography with an average center-line roughness Ra of 0.5 $\mu$m.

After rinsing with demineralized water the aluminum foil was then etched with an aqueous solution containing 300 g/l of sulfuric acid at 60° C. for 180 seconds and rinsed with demineralized water at 25° C. for 30 seconds.

The foil was subsequently subjected to anodic oxidation in an aqueous solution containing 200 g/l of sulfuric acid at a temperature of 45° C., a voltage of about 10 V and a current density of 150 A/m$^2$ for about 300 seconds to form an anodic oxidation film of 3.00 g/m$^2$ of $Al_2O_3$, then washed with demineralized water and posttreated with a 5% citric acid solution at room temperature during 90 seconds.

Preparation of the coating composition.

To 140 g of a 20% dispersion of polystyrene having a particle size of 70 nm and stabilized with 0.4 g surfactant Hostapal B (available from Hoechst, Germany) in deionized water was subsequently added while stirring 250 g of water containing 0.35 g of a wetting agent, ammonium hydroxide to raise the pH to 8.1, 26 g of a 15% dispersion of carbon black containing a wetting agent in water, 434 g of water, 400 g of a 2% solution of 98 mole % hydrolyzed polyvinylacetate (Mowiol 56-98 available from hoechst, Germany) in water.

Preparation of the imaging element.

An imaging element was produced by preparing the above described coating composition, coating it onto the above described lithographic base in an amount of 20 g/m$^2$ (wet coating weight) and drying it at 50° C.

Preparation of a printing plate and making copies thereof.

The imaging element was exposed on an internal drum recorder with a scanning infrared laser emitting at 1.06 $\mu$m having a scan speed of 218 m/s, spot size of 10 $\mu$m and with a pixel dwell time of 0.05 $\mu$s. Different energy levels in the image plane were tested: 2.22 mJ/mm$^2$, 1.70 mJ/mm$^2$ and 1.50 mJ/mm$^2$.

After exposing the plates were processed in Ozasol EN 144 (negative developer with pH 8.3 available from Agfa A.G., Germany) The obtained lithographic printing plates were used to print in an identical way on a conventional offset press using a common ink and fountain solution. The density of the printed images was measured after specified number of prints. The exposed and developed plates gave rise to unacceptable ink acceptance (even after 100 prints still unacceptable at the highest energy level, the lower energy levels were even worse.)

EXAMPLE 2

(Example According to the Invention)

Preparation of the coating solution.

To 546 g of a 20.6% dispersion of polystyrene having a particle size of 70 nm and stabilized with 2.3 g surfactant Hostapal B (available from Hoechst, Germany) in deionized water was subsequently added while stirring 2104 g of water containing 5 g of a wetting agent, ammonium hydroxide to raise the pH to 8.1, 100 g of a 15% dispersion of carbon black containing a wetting agent in water and 2250 g of a 1.5% solution of a compound according to formula I wherein n is 70%, p is 3%, m+q is 27% with a molecular weight of 60,000 in water.

Preparation of the imaging element.

An imaging element was produced by preparing the above described coating composition, coating it onto the above described lithographic base in an amount of 20 g/m$^2$ (wet coating weight) and drying it at 50° C.

Preparation of a printing plate and making copies thereof.

The imaging element was exposed on an internal drum recorder with a scanning infrared laser emitting at 1.06 $\mu$m having a scan speed of 367 m/s, spot size of 10 $\mu$m, with a pixel dwell time of 0.032 $\mu$s and energy in the image plane 0.55 mJ/mm$^2$ (resolution exposure).

After exposing the plate was processed in Ozasol EN 144 (negative developer with pH 8.3 available from Agfa A.G., Germany) The obtained lithographic printing plate was used to print in an identical way as in example 1 on a conventional offset press using a common ink and fountain solution. The density of the printed images was measured after specified number of prints. The exposed and developed plates gave rise to very good ink acceptance (<10 prints).

EXAMPLE 3

(Example According to the Invention)

Preparation of the coating solution.

To 619 g of a 20.6% dispersion of polystyrene having a particle size of 70 nm and stabilized with 2.5 g surfactant Hostapal B (available from Hoechst, Germany) in deionized water was subsequently added while stirring 3531 g of water containing 5 g of a wetting agent, ammonium hydroxide to raise the pH to 8.1, 100 g of a 15% dispersion of carbon black containing a wetting agent in water and 750 g of a 1% solution of a compound according to formula I wherein n is 70%, p is 3%, m+q is 27% with a molecular weight of 60,000 in water.

Preparation of the imaging element.

An imaging element was produced by preparing the above described coating composition, coating it onto the above described lithographic base in an amount of 20 g/m$^2$ (wet coating weight) and drying it at 50° C.

Preparation of a printing plate and making copies thereof.

The imaging element was exposed on an internal drum recorder with a scanning infrared laser emitting at 1.06 $\mu$m having a scan speed of 367 m/s, spot size of 10 $\mu$m, with a pixel dwell time of 0.032 $\mu$s and energy in the image plane 0.45 mJ/mm$^2$ (resolution exposure).

After exposing the plate was processed in Ozasol EN 144 (negative developer with pH 8.3 available from Agfa A.G., Germany) The obtained lithographic printing plate was used to print in an identical way as in example 1 on a conventional offset press using a common ink and fountain solution. The density of the printed images was measured after specified number of prints. The exposed and developed plates gave rise to very good ink acceptance (<10 prints). It can be seen that this plate, which has a higher percentage of polystyrene in the sensitive layer than the imaging element of example 2 needs a lower energy level by exposure (has thus a higher sensitivity).

EXAMPLE 4

(Example According to the Invention)

A lithographic base A was prepared as described in example 1 with the exception that the anodized foil was posttreated with a solution of polyvinyl phosphonic acid. A lithographic base B was prepared in a identical way as lithographic base A with the exception that the aluminum foil was electrochemically grained in a solution of nitric acid. Both lithographic bases were coated, exposed and developed as in example 3 with the exception that the energy in the image plane was adjusted to obtain the resolution exposure. The imaging element with the lithographic base B had a higher sensitivity than the imaging element with the lithographic base A. The ink acceptance of both plates was very good.

We claim:

1. A heat sensitive imaging element comprising a lithographic base with a hydrophilic surface, an image forming layer including a hydrophobic thermoplastic polymer latex and a compound capable of converting light into heat being present in said image forming layer or a layer adjacent thereto, wherein the image forming layer includes an alkali soluble copolymer which has a structure as represented by formula I, wherein n ranges from 50 to 78% m ranges from 21 to 49% p ranges from 1 to 5% q ranges from 0 to 28%

Form I

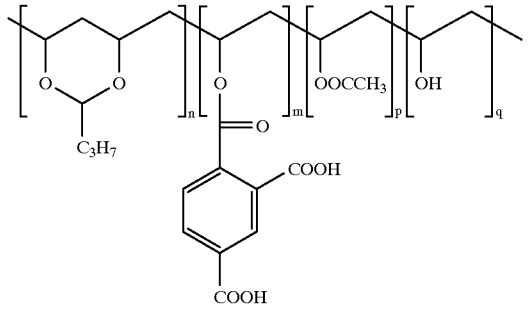

2. A heat sensitive imaging element according to claim 1 wherein said hydrophobic thermoplastic polymer latex is a polystyrene copolymer.

3. A heat sensitive imaging element according to claim 1 wherein said hydrophobic thermoplastic polymer latex is polystyrene itself or a polymer of a substituted styrene.

4. A heat sensitive imaging element according to claim 1 wherein said hydrophobic thermoplastic polymer latex has a particle size between 0.02 $\mu$m and 0.10 $\mu$m.

5. A heat sensitive imaging element according to claim 1 wherein said compound capable of converting light into heat is a member selected from the group consisting of an infrared absorbing dye and carbon black.

6. A method for obtaining a lithographic printing plate comprising the steps of:

(a) image-wise or information-wise exposing to light or heat an imaging element according to claim 1, (b) developing said exposed imaging element with an aqueous developing solution in order to remove the unexposed areas and thereby form a lithographic printing plate.

7. A method for obtaining a lithographic printing plate according to claim 6 wherein an IR-laser is used for said exposing.

8. A method for obtaining a lithographic printing plate according to claim 6 further comprising the step of gumming said exposed and developed material.

9. A method for obtaining a lithographic printing plate according to claim 8 further comprising the step of finally baking said exposed, developed and gummed material at a temperature between 100° C. and 300° C. for a period of 40 minutes to 30 seconds.

* * * * *